US007891770B2

(12) United States Patent
Wu et al.

(10) Patent No.: US 7,891,770 B2
(45) Date of Patent: Feb. 22, 2011

(54) SEPARATE LIGHT-EMITTING INK CARTRIDGE

(76) Inventors: Jun-Zhong Wu, No. 63, Mingzhubei Road, Xiang Zhou, District, Zhuhai, Guang Dong (CN) 519075; Yi Zhou, No. 63, Mingzhubei Road, Xiang Zhou, District, Zhuhai, Guang Dong (CN) 519075

( * ) Notice: Subject to any disclaimer, the term of this patent is extended or adjusted under 35 U.S.C. 154(b) by 238 days.

(21) Appl. No.: 11/884,067

(22) PCT Filed: Mar. 21, 2006

(86) PCT No.: PCT/CN2006/000439

§ 371 (c)(1),
(2), (4) Date: Jun. 6, 2008

(87) PCT Pub. No.: WO2007/025422

PCT Pub. Date: Mar. 8, 2007

(65) Prior Publication Data

US 2009/0135234 A1 May 28, 2009

(30) Foreign Application Priority Data

Aug. 30, 2005 (CN) ..... 2005 2 0063887 U

(51) Int. Cl.
*B41J 2/14* (2006.01)
*B41J 2/175* (2006.01)

(52) U.S. Cl. ..... 347/49; 347/86

(58) Field of Classification Search ..... 347/7, 347/19, 49, 86, 85

See application file for complete search history.

(56) References Cited

U.S. PATENT DOCUMENTS 5,997,121 A * 12/1999 Altfather et al. ..... 347/7
6,616,255 B2 * 9/2003 Murakami et al. ..... 347/7
6,767,075 B1 * 7/2004 Takada et al. ..... 347/19
6,935,716 B2 * 8/2005 Hatasa et al. ..... 347/19

* cited by examiner

*Primary Examiner*—Anh T. N. Vo
(74) *Attorney, Agent, or Firm*—Schulte Roth & Zabel LLP; John C. Garces

(57) ABSTRACT

A separate light-emitting ink cartridge including an ink container, an ink supply port, a shelf, a chip, a first joint portion, a second joint portion, a support component, and a light display portion is provided. The ink container and the shelf are independent workpiece respectively, and are detachably assembled together. The ink container has an ink storage chamber, and the ink supply port is disposed at the bottom of the ink container to supply ink accommodated in the ink container to an inkjet head. The chip, the first joint portion, the second joint portion, the support component, and the light display portion are disposed on the shelf. The separate light-emitting cartridge reduces the printing cost for users, and is environment friendly. Moreover, the structure of the separate light-emitting cartridge is simple and can be assembled conveniently.

8 Claims, 1 Drawing Sheet

SEPARATE LIGHT-EMITTING INK CARTRIDGE

BACKGROUND OF THE INVENTION

1. Field of Invention

The present invention relates to a separate light-emitting ink cartridge for an inkjet printer.

2. Description of Related Art

In conventional art, PRC Patent Application No. 200410103423.2 entitled "Liquid Container and Fabricating Method Thereof" has disclosed a liquid container which is detachably assembled on an mount portion of an inkjet recording apparatus. The container includes a shell forming a liquid holding chamber; a supply port disposed in the shell for supplying the liquid accommodated in the shell to an inkjet head; a first joint portion jointed with a first locking portion disposed in the mount portion and disposed on one side of the shell; a second joint portion jointed with a second locking portion disposed in the mount portion and disposed opposite to the other side of the shell, wherein one side and the other side of the shell are opposite; a support portion for movably supporting the second joint portion; an information storage portion for storing information relevant to the liquid container; contacts electrically connected to contacts disposed in the mount portion; a light-emitting portion; a display portion for guiding the light emitted from the light-emitting portion to the exterior of the liquid container. The supply port is disposed on a side between one side and the other side of the shell. The contacts are disposed in a corner region between the other side and the side where the supply port is disposed. And, the display portion is disposed adjacent to an upper portion of the other side of the liquid container in use.

Currently, ink cartridges are designed to be one time use only and the preset chips do not allow refilling, so the ink cartridges cannot be reused. After ink in the ink cartridges is used out, the plastic parts, ink residual, and chips cannot be degraded naturally. Moreover, printers cannot be normally used until new ink cartridges are purchased and installed, which leads to an environment pollution, and increases the printing cost of users.

SUMMARY OF THE INVENTION

In order to solve the problems of high cost of inkjet ink cartridges and high printing cost of users and to alleviate the pollution to the environment, the present invention is directed to provide a separate light-emitting ink cartridge, which reduces the printing cost of users and alleviates the pollution to the environment.

The technical scheme of the present invention directed to solving the above technical problems is described as follows.

A separate light-emitting ink cartridge including an ink container, an ink supply port, an shelf, a chip, a first joint portion, a second joint portion, a support component, and a light display portion is provided. The ink container and the shelf are independent workpiece respectively, and are detachably assembled together. The ink container has an ink storage chamber, and the ink supply port is disposed at the bottom of the ink container to supply the ink accommodated in the ink container to an inkjet head. The chip, the first joint portion, the second joint portion, the support component, and the light display portion are disposed on the shelf. A first side of the shelf has the first joint portion, and a second side opposite to the first side resiliently supports the support component of the second joint portion.

The chip is disposed in a corner region of a bottom portion of the second side, and the light display portion is disposed at an upper portion of the second side.

A light-emitting body of the light display portion is disposed on the chip, and the light-emitting body is, for example, a light-emitting diode.

The ink container has an ink supply chamber and the ink storage chamber which are connected with capillary grooves. The ink supply port is disposed at a bottom of the ink supply chamber, an elongated fiber bundle is disposed in the ink supply chamber, and the fiber bundle directly contacts the inkjet head.

The present invention has the advantages of reducing the printing cost of users, recycling the chip and the light display portion, which is environment friendly, and providing a simple structure which can be assembled conveniently.

In order to make the aforementioned and other objects, features and advantages of the present invention comprehensible, a preferred embodiment accompanied with figures is described in detail below.

DESCRIPTION OF EMBODIMENTS

Figure 1:
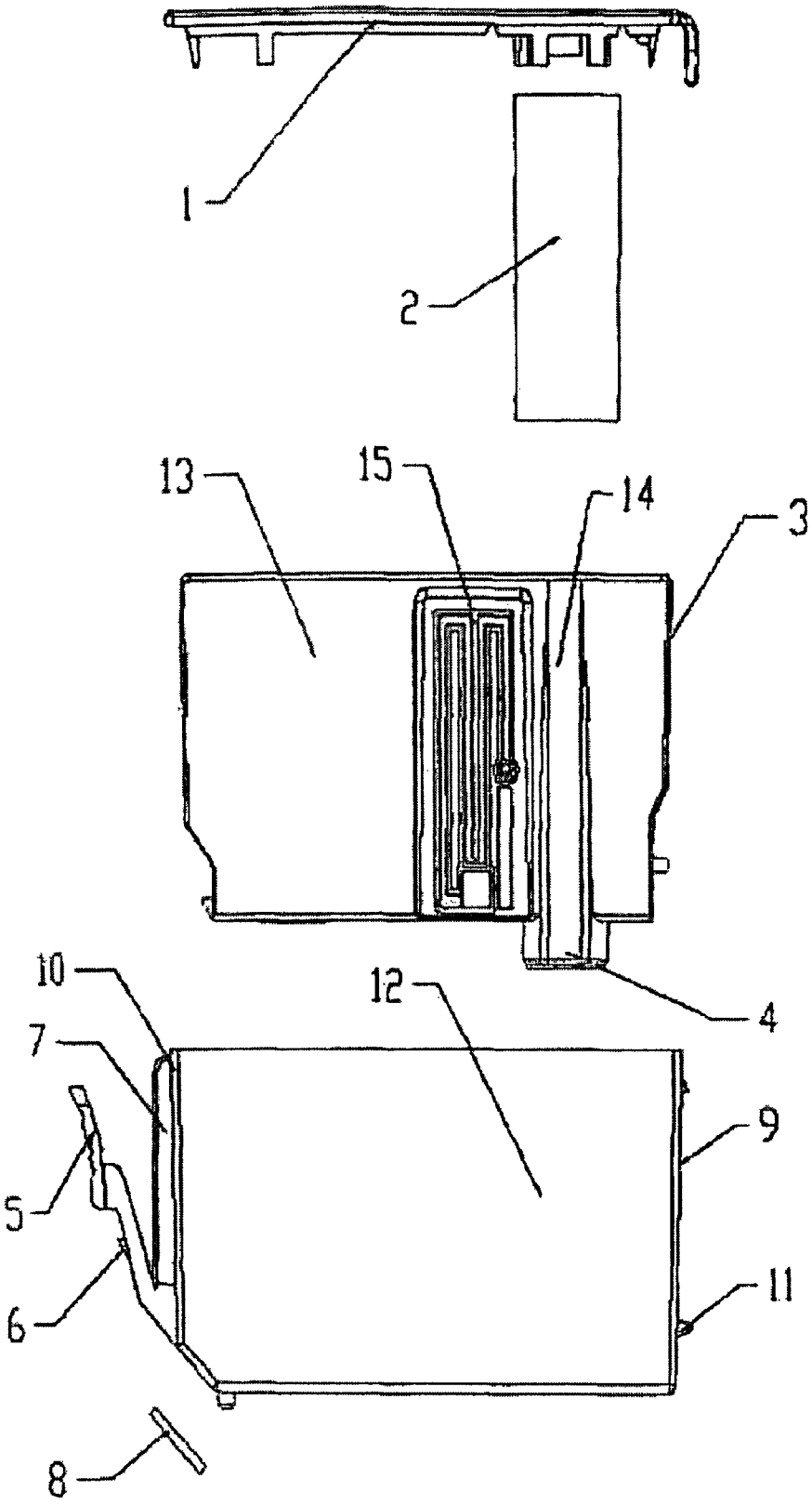
FIG. 1 is a schematic exploded view of the structure of the present invention.

FIG. 1 shows a separate light-emitting ink cartridge, which includes an ink container 3, an ink supply port 4, a lid 1, a shelf 12, a chip 8, a first joint portion 11, a second joint portion 6, a support component 5, and a light display portion 7. The ink container 3 and the shelf 12 are independent workpiece respectively, and are detachably assembled together. The ink container 3 has an ink storage chamber 13, and an ink supply port 4 is disposed at the bottom of the ink container 3 to supply the ink accommodated in the ink container to an inkjet head. The chip 8, the first joint portion 11, the second joint portion 6, the support component 5, and the light display portion 7 are disposed on the shelf 12. The first joint portion 11 is disposed on a first side 9 of the shelf 12, and a second side 10 opposite to the first side 9 movably supports the support component 5 of the second joint portion 6. The chip 8 is disposed in a corner region of a bottom portion of the second side 10 on the shelf 12, and the light display portion 7 is disposed in an upper portion of the second side 10. The ink container includes an ink supply chamber 14 and the ink storage chamber 13 which are connected with capillary grooves 15. The ink supply port 4 is disposed at the bottom of the ink supply chamber 14, an elongated fiber bundle 2 is disposed in the ink supply chamber 14, and the fiber bundle 2 directly contacts the inkjet head.

A light-emitting body of the light display portion is disposed on the chip 8, and the light-emitting body is, for example, a light-emitting diode.

What is claimed is:

1. A separate light-emitting ink cartridge, comprising an ink container, an ink supply port, a shelf, a chip, a first joint portion, a second joint portion, a support component, and a light display portion, wherein the ink container and the shelf are independent workpiece respectively, and are detachably assembled together, the ink container has an ink storage chamber, and the ink supply port is disposed at a bottom of the ink container to supply ink accommodated in the ink container to an inkjet head; the chip, the first joint portion, the second joint portion, the support component, and the light display portion are disposed on the shelf.

2. The separate light-emitting ink cartridge as claimed in claim 1, wherein the first joint portion is disposed on a first side of the shelf, and a second side opposite to the first side resiliently supports the support component of the second joint portion.

3. The separate light-emitting ink cartridge as claimed in claim 2, wherein the ink container has an ink supply chamber and the ink storage chamber which are connected with capillary grooves, the ink supply port is disposed at the bottom of the ink supply chamber, an elongated fiber bundle is disposed in the ink supply chamber, and the fiber bundle directly contacts an inkjet head.

4. The separate light-emitting ink cartridge as claimed in claim 1, wherein the chip is disposed in a corner region of a bottom portion of the second side on the shelf, and the light display portion is disposed at an upper portion of the second side.

5. The separate light-emitting ink cartridge as claimed in claim 4, wherein a light-emitting body of the light display portion is disposed on the chip.

6. The separate light-emitting ink cartridge as claimed in claim 4, wherein the ink container has an ink supply chamber and the ink storage chamber which are connected with capillary grooves, the ink supply port is disposed at the bottom of the ink supply chamber, an elongated fiber bundle is disposed in the ink supply chamber, and the fiber bundle directly contacts an inkjet head.

7. The separate light-emitting ink cartridge as claimed in claim 1, wherein the ink container has an ink supply chamber and the ink storage chamber which are connected with capillary grooves, the ink supply port is disposed at the bottom of the ink supply chamber, an elongated fiber bundle is disposed in the ink supply chamber, and the fiber bundle directly contacts an inkjet head.

8. The separate light-emitting ink cartridge as claimed in claim 7, wherein the ink container is an ink tank, and a pressure control valve is disposed at the ink supply port.

* * * * *